US006925280B2

(12) United States Patent
Yamada

(10) Patent No.: US 6,925,280 B2
(45) Date of Patent: Aug. 2, 2005

(54) FIXING DEVICE AND IMAGE FORMING APPARATUS INCLUDING THE SAME

(75) Inventor: Masamichi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/408,224

(22) Filed: Apr. 8, 2003

(65) Prior Publication Data

US 2003/0215270 A1 Nov. 20, 2003

(30) Foreign Application Priority Data

Apr. 11, 2002 (JP) ..... 2002-108771

(51) Int. Cl.[7] ..... G03G 15/20
(52) U.S. Cl. ..... 399/325
(58) Field of Search ..... 399/324, 325, 399/326

(56) References Cited

U.S. PATENT DOCUMENTS

| | | | | | |
|---|---|---|---|---|---|
| 4,136,613 | A | * | 1/1979 | Namiki | 399/325 |
| 4,231,653 | A | * | 11/1980 | Nagahara et al. | 399/325 |
| 5,099,289 | A | * | 3/1992 | Kurotori et al. | 399/325 |
| 5,145,525 | A | * | 9/1992 | Fromm et al. | 399/325 |
| 6,035,173 | A | * | 3/2000 | Kagawa | 399/325 |
| 6,070,045 | A | * | 5/2000 | Hara et al. | 399/325 |
| 6,088,558 | A | | 7/2000 | Yamada et al. | 399/329 X |
| 6,091,926 | A | | 7/2000 | Yamada | 399/329 |
| 6,351,619 | B1 | | 2/2002 | Yamada | 399/329 X |
| 6,360,072 | B1 | * | 3/2002 | Costrop et al. | 399/325 |
| 6,553,204 | B1 | | 4/2003 | Yamada | 399/328 |
| 6,577,838 | B2 | * | 6/2003 | Fujita et al. | 399/325 |
| 6,577,840 | B2 | | 6/2003 | Hachisuka et al. | 399/329 |
| 6,591,081 | B2 | * | 7/2003 | Hasegawa | 399/325 |

FOREIGN PATENT DOCUMENTS

| | | |
|---|---|---|
| EP | 0 864 943 | 9/1998 |
| EP | 1 022 622 | 7/2000 |
| JP | 2000-155492 | 6/2000 |

OTHER PUBLICATIONS

Patent Abstracts of Japan, JP 02–137877, May 28, 1990.
Patent Abstracts of Japan, JP 10–301428, Nov. 13, 1998.

* cited by examiner

*Primary Examiner*—Hoang Ngo
(74) *Attorney, Agent, or Firm*—Oblon, Spivak, McClelland, Maier & Neustadt, P.C.

(57) ABSTRACT

A fixing device for an image forming apparatus includes a fixing member and coating member in contact there with for coating a parting agent on the surface of the fixing member. A feeding member is in contact with the coating member in order to feed the parting agent to the coating member. A holding member contains the parting agent and is held in sliding contact with the feeding member to thereby deposit the parting agent on the feeding member. The rotational speed of the coating member is controlled by a coefficient of friction between the coating member and the fixing member.

48 Claims, 3 Drawing Sheets

FIXING DEVICE AND IMAGE FORMING APPARATUS INCLUDING THE SAME

BACKGROUND OF THE INVENTION

1. Field of the Invention

The present invention relates to a fixing device of the type fixing a toner image carried on a recording medium with heat and pressure and an image forming apparatus including the same.

2. Description of the Background Art

A fixing device of the type described has customarily been included in an electrophotographic copier, printer, facsimile apparatus or similar image forming apparatus. A problem with this type of fixing device is that toner is apt to deposit on a fixing member and then deposit on a recording medium being conveyed via the fixing member, smearing the recording medium. In light of this, it is a common practice to coat a parting agent on the circumference of the fixing member.

Various systems have heretofore been proposed for coating a parting agent on the fixing member of the fixing device. One of the conventional systems includes a coating member held in contact with the fixing member and rotatable by following the rotation of the fixing member. In this system, a feeding member is held in contact with the coating member and rotatable by following the rotation of the coating member for thereby applying a parting agent to the coating member. Further, a holding member holding the parting agent is held in contact with the feeding member. The parting agent is therefore fed from the holding member to the fixing member via the feeding member and coating member.

The system described above has the following problem left unsolved. For example, when a recording medium jams a path inside the fixing device, the operator is expected to rotate the fixing member in a direction opposite to a direction assigned to fixation in order to remove the recording medium. At this instant, it is likely that impurities, including toner and paper dust and accumulated between the feeding member and the holding member, are conveyed to a nip between the feeding member and the coating member, obstructing stable feed of the parting agent to the fixing member. Further, such impurities are apt to damage the fixing member, feeding member, coating member and so forth due to friction.

Technologies relating to the present invention are disclosed in, e.g., Japanese Patent Laid-Open Publication No. 2000-155492.

SUMMARY OF THE INVENTION

It is an object of the present invention to provide a fixing device capable of stably feeding a parting agent to a fixing member even when impurities accumulate between a feeding member and a holding member and an image forming apparatus including the same.

It is another object of the present invention to provide a fixing device capable protecting a recording medium from smears and protecting a fixing member, a feeding member, a coating member and so forth from damage and an image forming apparatus including the same.

A fixing device for an image forming apparatus of the present invention includes a fixing member. A coating member is rotatable in contact with the fixing member by following the rotation of the fixing member for thereby coating a parting agent on the fixing member. A feeding member is rotatable in contact with the coating member by following the rotation of the coating member for thereby feeding the parting agent to the coating member. A holding member holds the parting agent and is held in sliding contact with the feeding member to thereby deposit the parting agent on the feeding member. When the fixing member is rotated in a direction opposite to a direction assigned to fixation while causing the coating member to rotate, a rotation limiting member prevents the feeding member from rotating by following the rotation of the coating member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
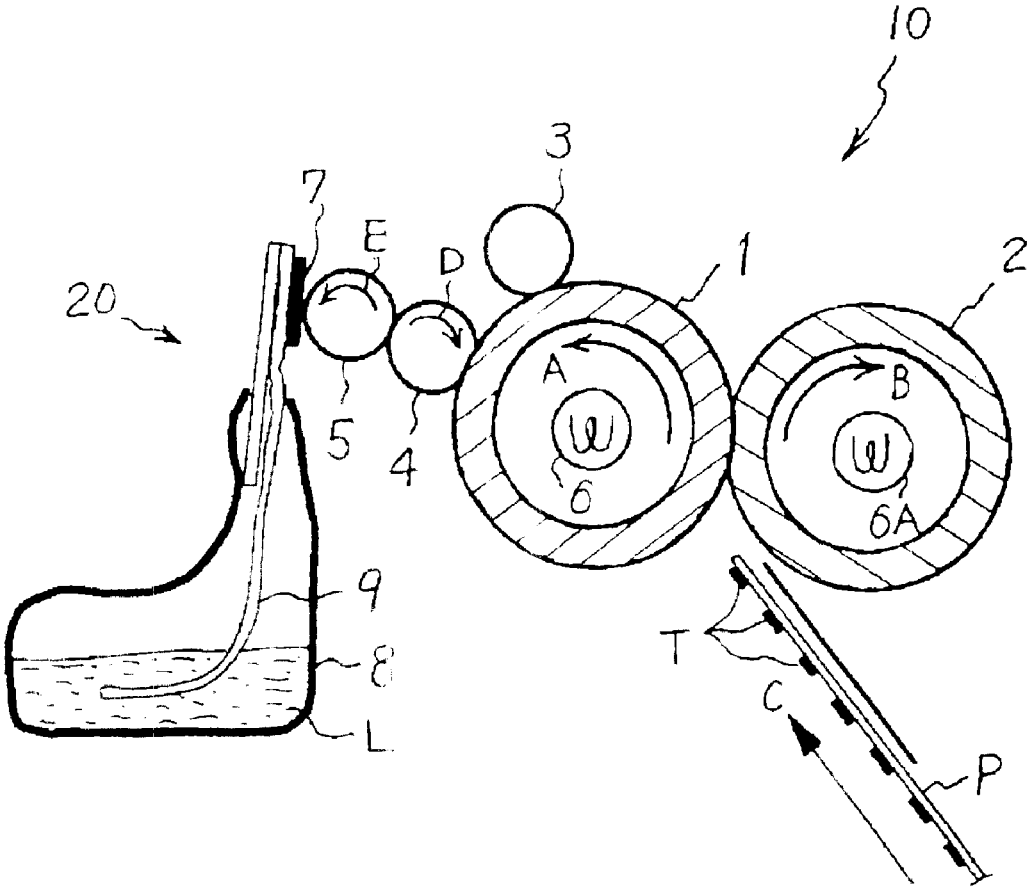
FIG. 1 is a section showing a fixing device embodying the present invention.

Referring to FIG. 1 of the drawings, a fixing device embodying the present invention is shown and included in an image forming apparatus not shown. As shown, the fixing device, generally 10, includes a heat roller 1 and a press roller 2 each being a specific form of a fixing member. A driveline, not shown, causes the heat roller 1 and press roller 2 to rotate in directions A and B, respectively. Heat sources 6 and 6A, which may be implemented by halogen lamps, are disposed in the heat roller 1 and press roller 2, respectively. The heat sources 6 and 6A respectively heat the heat roller 1 and press roller 2 to temperature adequate for fixation when energized.

The heat roller 1 and press roller 2 each may be provided with any suitable configuration. For example, the rollers 1 and 2 each may be made up of a hollow metallic core, a 2 mm thick elastic layer formed on the core by use of silicone rubber, a 10 $\mu$m thick fluorocarbon rubber layer formed on the elastic layer, and a 70 $\mu$m thick, parting layer formed on the rubber layer by use of silicone rubber. In such a case, the roller 1 or 2 will have a diameter of about 45 mm. The fluorocarbon rubber layer is used to prevent the elastic, silicone rubber layer from swelling with silicone oil, which will be described later.

A toner image T is formed on a recording medium P, which may be a paper sheet or a resin film by way of example, by an image forming section included in the image forming apparatus. The sheet P is conveyed to a nip between the heat roller 1 and the press roller 2, which are respectively moving in the directions A and B in contact with each other, in a direction C. At this instant, the toner image T contacts the circumference of the heat roller 1 and is therefore melted by heat and pressure to be fixed on the recording medium P. The recording medium P moved away from the above nip is driven out of the fixing device 10.

If a large amount of toner deposited on the recording medium P is transferred to the heat roller 1, then the toner is again transferred to the recording medium P and smears it. To solve this problem, the illustrative embodiment additionally includes a coating device 20 for coating a parting agent on the heat roller 1, as will be described hereinafter.

The coating device 20 includes a coating roller or coating member 4 held in contact with the heat roller 1. When the heat roller 1 rotates in the direction A, it causes the coating roller 4 to rotate in a direction D. A feeding roller or feeding member 5 is held in contact with the coating roller 4. The coating roller 4, rotating in the direction D, causes the feeding roller 5 to rotate in a direction E. A holding member 7 is formed of felt, foam or similar porous material capable of holding a parting agent therein. The holding member 7 is held in contact with the feeding roller 5 and slides on the feeding member 5 when the roller 5 is in rotation.

A container 8 stores silicone oil or similar parting agent L implemented as a liquid. A drawing member 9, which is formed of felt, foam or similar porous material, draws up the parting agent L from the container 8 and feeds it to the feeding member 7. If desired, the holding member 7 and drawing member 9 may be implemented as a single member.

The parting agent fed from the drawing member 9 to the holding member 7, as stated above, is transferred to the coating roller 4 via the feeding roller 5 and then transferred from the coating roller 4 to the heat roller 1. The parting agent thus coated on the heat roller 1 allows a minimum of toner to deposit on the circumference of the heat roller 1. Toner deposited on the heat roller 1, if any, and paper dust and other impurities are removed by a cleaning roller 3 contacting the heat roller 1.

Assume that a plurality of recording media P are continuously conveyed via the nip between the heat roller 1 and the press roller 2 with the result that the parting agent coated on the heat roller 1 becomes short. Then, the coefficient of friction between the heat roller 1 and the coating roller 4 and therefore the rotation speed of the coating roller 4 increases. Consequently, the parting agent deposited on the coating roller 4 is transferred to the heat roller 1 in a large amount, settling the shortage. Likewise, when the parting agent on the coating roller 4 becomes short, the coefficient of friction between the coating roller 4 and the feeding roller 5 and therefore the rotation speed of the feeding roller 5 increases, feeding a large amount of parting agent to the coating roller 4. Further, as the rotation speed of the feeding roller 5 becomes higher, a larger amount of parting agent is transferred from the holding member 7 to the feeding roller 5 at the position where the two members 7 and 5 contact each other. On the other hand, when a large amount of parting agent is present on the heat roller 1 or the coating roller 4, the rotation speed of the coating roller 4 or that of the feeding roller 5 is lowered to thereby limit the amount of parting agent to deposit on the heat roller 1.

As stated above, the coefficients of friction between the heat roller 1 and the coating roller 4, between the coating roller 4 and the feeding roller 5 and between the feeding roller 5 and the holding member 7 each vary in accordance with the amount of parting agent deposited thereon. By using such a relation, the illustrative embodiment automatically coats an adequate amount of parting agent on the heat roller 1, preventing the parting agent on the heat roller 1 from becoming short or excessive.

Figure 2:
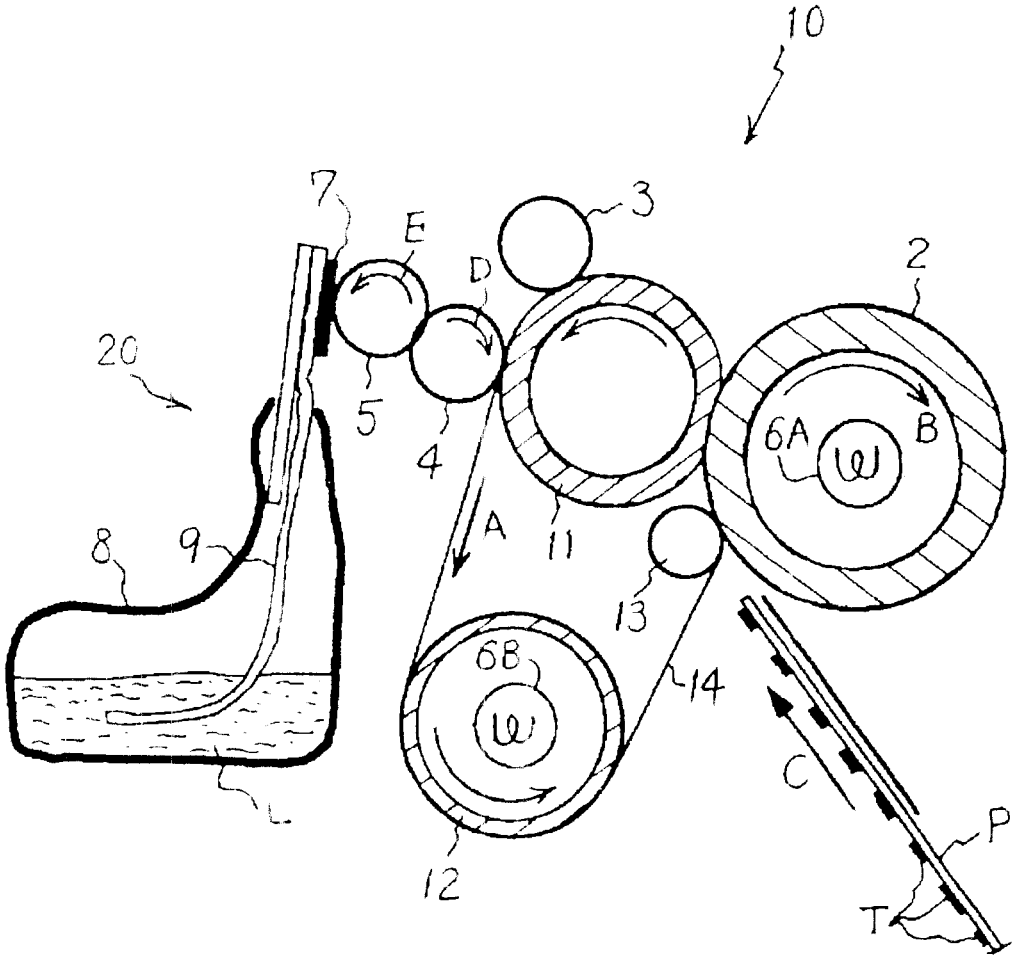
FIG. 2 is a section showing an alternative embodiment of the present invention.

Reference will be made to FIG. 2 for describing an alternative embodiment of the present invention. As shown, the fixing device 10 includes an endless, fixing belt (simply belt hereinafter) 14 passed over a plurality of support rollers 11, 12 and 13 and constituting one fixing member. The belt 14 has a parting layer on its outer surface and is driven to turn in a direction A. The support roller 11 is made up of a metallic core and an elastic layer covering the core. The press roller 2, which is the other fixing member, is pressed against the support roller 11 with the intermediary of the belt 14, forming a nip between the press roller 2 and the belt 14. The press roller 2 is driven to rotate in a direction B. A heat source 6B, which may be implemented as a halogen lamp, is disposed in the support roller 12 in order to heat the belt 14 when energized. Likewise, a heat source 6A is disposed in the press roller 2 in order to heat the press roller 2.

The belt 14 is made up of, e.g., a 90 $\mu$m thick base formed of polyimide resin and a 200 $\mu$m thick parting layer formed on the outer surface of the base and formed of silicone rubber having a high parting ability.

The recording medium P carrying a toner image T thereon is conveyed via the nip between the belt 14 and the press roller 2 rotating in the directions A and B, respectively. At this instant, the toner image T contacts the belt 4 and is melted by heat and pressure to be fixed on the recording medium P thereby.

If a large amount of toner is transferred from the recording medium P to the belt 14 during fixation, then it smears the recording medium P. In light of this, the cleaning roller 3 and coating device 20 are arranged in exactly the same manner as in the previous embodiment. The cleaning roller 3 is held in contact with the outer surface of the belt 14.

The coating device 20 shown in FIG. 2 is identical with the coating device 20 shown in FIG. 1 except that the coating roller 4 does not contact the heat roller 1, but contacts the outer surface of the belt 14. In FIG. 2, structural elements identical with the structural elements of FIG. 1 are designated by identical reference numerals and will not be described specifically in order to avoid redundancy. In the illustrative embodiment, too, the coating device 20 can automatically coat an adequate amount of parting agent on the belt 14.

As stated above, in the illustrative embodiments, the fixing device includes a fixing member (heat roller 1, FIG. 1, or belt 14, FIG. 2), a coating member held in contact with and driven by the fixing member, a feeding member held in contact with and driven by the coating member, and a holding member held in contact with the feeding member for depositing a parting agent on the feeding member.

Figure 3:
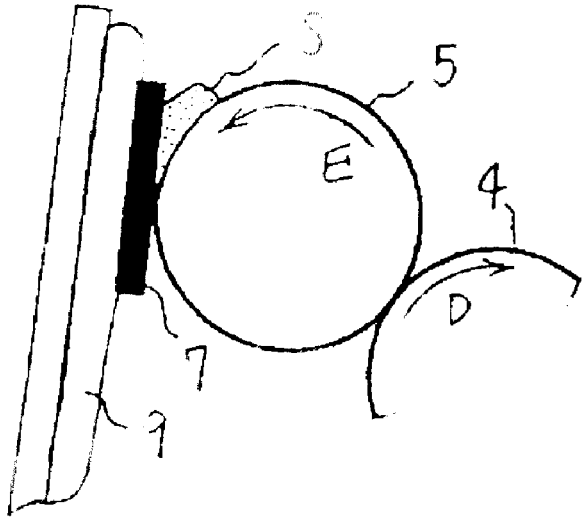
FIG. 3 is a fragmentary view showing a condition wherein impurities accumulate in a wedge-like space between a holding member and a feeding member included in the illustrative embodiment.

In the illustrative embodiments, the cleaning roller 3 is expected to remove toner and impurities, including paper dust, deposited on the heat roller 1 or the belt 14 in a small amount. However, an extremely small amount of toner and impurities squeezes under the cleaning roller 3 and deposits on the feeding member 5 by way of the coating member 4. As a result, as shown in FIG. 3, the toner and impurities, labeled S, accumulate in a wedge-like space upstream of the holding member 7 in the direction of rotation E of the feeding member 5. Particularly, the amount of such impurities S increases when use is made of, e.g., recycled paper sheets containing much paper dust.

When the recording medium P jams the path in the fixing device 10 in the condition shown in FIG. 3, the press roller 2 and heat roller 1 or belt 14 stop rotating. Subsequently, the operator of the image forming apparatus removes the recording medium P by rotating the heat roller 1 or the belt 14 in the direction opposite to the direction A by hand.

Figure 4:
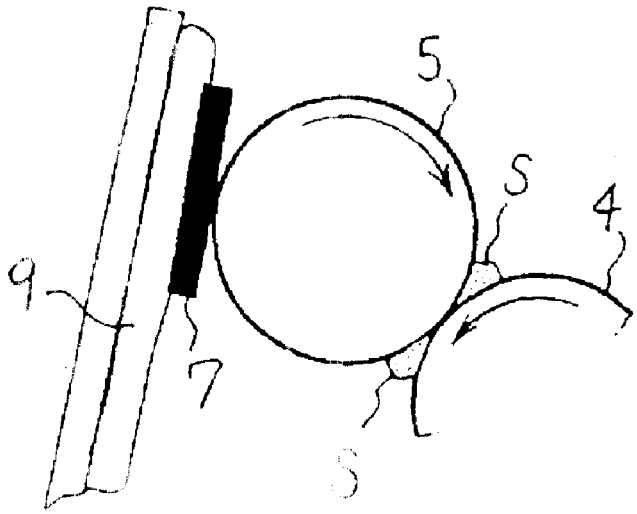
FIG. 4 is a view similar to FIG. 3, showing the impurities conveyed to a nip between the feeding member and a coating member also included in the illustrative embodiment.

Assume that when the operator rotates the heat roller 1 or the belt 14 in the above direction, the coating member 4 and feeding member 5 respectively rotate in the direction opposite to the direction D and the direction opposite to the direction E, following the movement of the heat roller 1 or the belt 14. Then, as shown in FIG. 4, the impurities S are conveyed by the feeding member 5 to the nip between the feeding member 5 and the coating member 4. If the fixing operation is resumed in the condition shown in FIG. 4, then the automatic control over the amount of parting agent to be coated does not work in the expected manner due to the variation of the coefficient of friction between the coating member 4 and the feeding member 5. Consequently, the parting agent cannot be stably coated on the heat roller 1 or the belt 14 in an adequate amount.

Further, if the amount of impurities S nipped between the coating member 4 and the feeding member 5 is large, then the two members 4 and 5 are locked and practically fail to coat the parting agent on the heat roller 1 or the belt 14. In the worst case, the feeding member, coating member 4 and so forth are damaged. In addition, should the impurities S be transferred to the heat roller 1 or the belt 14, they would be transferred to the recording medium P when the fixing operation is resumed.

To solve the above problems ascribable to the impurities S, the illustrative embodiments shown and described each include rotation limiting means for preventing the coating member 4 from rotating when the operator rotates the fixing member (heat roller 1 or the belt 14) in the direction opposite to the direction for fixation. The rotation limiting means may be implemented as a one-way clutch, not shown, mounted on the bearing of the coating member 4, so that the coating member 4 does not rotate in the direction opposite to the direction D. In this condition, the coating member 4 and therefore the feeding member 5 does not follow the rotation of the heat roller 1 or the belt 14 effected by hand in the event of, e.g., jam processing. This successfully prevents the impurities S shown in FIG. 3 from being conveyed to the nip between the feeding member 5 and the coating member 4 and thereby solves the problems stated above.

Alternatively, the rotation limiting means may be implemented as a one-way clutch, not shown, mounted on the bearing of the feeding member 5, so that the feeding member 5 does not rotate in the direction opposite to the direction E when the heat roller 1 or the belt 14 is rotated by hand for the purpose stated above. This is also successful to prevent the impurities S shown in FIG. 3 from being conveyed to the nip between the feeding member 5 and the coating member 4.

As stated above, even when the impurities S accumulate in the space between the holding member 7 and the feeding member 5, as shown in FIG. 3, they are confined in the above space. The parting agent can therefore be stably fed to the heat roller 1 or the fixing belt 14 in an adequate amount. Also, the feeding member 5, coating member 4 and heat roller 1 or belt 14 are free from damage ascribable to the impurities S while the impurities S are prevented from depositing on the recording medium P. The illustrative embodiments therefore insure high image quality at all times.

While in the illustrative embodiments shown and described the coating device 20 is assigned to one of a pair of fixing members, it may be assigned to each of the fixing members. Particularly, in an image forming apparatus capable of forming toner images on both sides of a recording medium and fixing then with a fixing device, a particular coating device should preferably be assigned to each of the fixing members so as to prevent toner from depositing on the fixing members.

The present invention is similarly applicable to any other type of fixing device, e.g., one in which a pair of fixing members both are implemented as endless belts, one in which one fixing member is a stationary member not rotatable or one in which a recording medium is conveyed by an endless belt or image carrier and passed though a nip between a pair of fixing members together with the belt.

In summary, it will be seen that the present invention provides a fixing device capable of stably feeding a parting agent to a fixing member even when impurities accumulate between a feeding member and a holding member. Further, the fixing device of the present invention frees a recording medium from smear ascribable to the impurities while protecting the fixing member, coating member and feeding member from damage.

Various modifications will become possible for those skilled in the art after receiving the teachings of the present disclosure without departing from the scope thereof.

What is claimed is:

1. A fixing device comprising:

a fixing member;

a coating member rotationally in contact with a circumference of said fixing member by following rotation of said fixing member to thereby coat a parting agent on said fixing member;

a feeding member rotationally in contact with said coating member by following rotation of said coating member to thereby feed the parting agent to said coating member;

a holding member holding the parting agent and held in sliding contact with said feeding member to thereby deposit said parting agent on said feeding member; and rotation limiting means for preventing, when said fixing member is rotated in a direction opposite to a direction assigned to fixation, said coating member from rotating by following rotation of said fixing member, wherein a rotational speed of the coating member is controlled by a coefficient of friction between the coating member and the fixing member.

2. The fixing device as claimed in claim 1, wherein said fixing member further comprises:

a pair of fixing members, wherein a recording medium carrying a toner image thereon is passed through a nip between said pair of fixing members to have said toner image fixed by heat and pressure, said coating member is held in contact with an outside surface of at least one of said pair of fixing members, said feeding member is held in contact with said coating member, and said holding member is held in contact with said feeding member.

3. The fixing device as claimed in claim 1, wherein one of said pair of fixing members comprises a heat roller while the other of said pair of fixing members comprises a press roller.

4. The fixing device as claimed in claim 1, wherein one of said pair of fixing members comprises an endless fixing belt passed over a plurality of support rollers while the other of said pair of fixing members comprises a press roller.

5. In an image forming apparatus comprising a fixing device, said fixing device comprising:

a fixing member;

a coating member rotationally in contact with a circumference of said fixing member by following rotation of said fixing member to thereby coat a parting agent on said fixing member;

a feeding member rotationally in contact with said coating member by following rotation of said coating member to thereby feed the parting agent to said coating member;

a holding member holding the parting agent and held in sliding contact with said feeding member to thereby deposit said parting agent on said feeding member; and rotation limiting means for preventing, when said fixing member is rotated in a direction opposite to a direction assigned to fixation, said coating member from rotating by following rotation of said coating member, wherein a rotational speed of the coating member is controlled by a coefficient of friction between the coating member and the fixing member.

6. The apparatus as claimed in claim 5, wherein said fixing member further comprises:

a pair of fixing members, wherein a recording medium carrying a toner image thereon is passed through a nip between said pair of fixing members to have said toner image fixed by heat and pressure, said coating member is held in contact with an outside surface of at least one of said pair of fixing members, said feeding member is held in contact with said coating member, and said holding member is held in contact with said feeding member.

7. The fixing device as claimed in claim 5, wherein one of said pair of fixing members comprises a heat roller while the other of said pair of fixing members comprises a press roller.

8. The fixing device as claimed in claim 5, wherein one of said pair of fixing members comprises an endless fixing belt passed over a plurality of support rollers while the other of said pair of fixing members comprises a press roller.

9. The fixing device as claimed in claim 1, wherein an amount of parting agent coated in the fixing member is based on the coefficient of friction between the coating member and the fixing member.

10. The fixing device as claimed in claim 1, wherein a rotational speed of the feeding member is controlled by a coefficient of friction between the feeding member and the coating member.

11. The fixing device as claimed in claim 1, wherein an amount of parting agent coated in the coating member is based on the coefficient of friction between the feeding member and the coating member.

12. The image forming apparatus as claimed in claim 5, wherein an amount of parting agent coated in the fixing member is based on the coefficient of friction between the coating member and the fixing member.

13. The image forming apparatus as claimed in claim 5, wherein a rotational speed of the feeding member is controlled by a coefficient of friction between the feeding member and the coating member.

14. The image forming apparatus as claimed in claim 5, wherein an amount of parting agent coated in the coating member is based on the coefficient of friction between the feeding member and the coating member.

15. The fixing device as claimed in claim 1, wherein the rotation limiting means is a one-way clutch mounted on a bearing of the coating member.

16. The fixing device as claimed in claim 1, wherein the rotation limiting means is a one-way clutch mounted on a bearing of the feeding member.

17. The image forming apparatus as claimed in claim 5, wherein the rotation limiting means is a one-way clutch mounted on a bearing of the coating member.

18. The image forming apparatus as claimed in claim 5, wherein the rotation limiting means is a one-way clutch mounted on a bearing of the feeding member.

19. A image forming apparatus comprising a fixing device, the fixing device, comprising:

at least two fixing members, each of the at least two fixing members further comprising:

a coating member in contact with the fixing member, the coating member being configured to coat a parting agent on a surface of the fixing member;

a feeding member in contact with the coating member, the feeding member being configured to feed the parting agent to a surface of the coating member;

a holding member configured to hold the parting agent, the holding member being positioned in a sliding contact with the feeding member and being configured to deposit the parting agent on a surface of the feeding member; and limiting means for preventing the coating member from rotating when the fixing member is rotated in a direction opposite to a fixing rotational direction, wherein a rotational speed of the coating member is controlled by a coefficient of friction between the coating member and the fixing member.

20. The image forming apparatus as claimed in claim 19, wherein an amount of parting agent coated in the fixing member is based on the coefficient of friction between the coating member and the fixing member.

21. The image forming apparatus as claimed in claim 19, wherein a rotational speed of the feeding member is controlled by a coefficient of friction between the feeding member and the coating member.

22. The image forming apparatus as claimed in claim 19, wherein an amount of parting agent coated in the coating member is based on the coefficient of friction between the feeding member and the coating member.

23. The image forming apparatus as claimed in claim 19, wherein the rotation limiting means is a one-way clutch mounted on a bearing of the feeding member.

24. The image forming apparatus as claimed in claim 19, wherein the rotation limiting means is a one-way clutch mounted on a bearing of the coating member.

25. A fixing device comprising:

a fixing member;

a coating member rotationally in contact with a circumference of said fixing member by following rotation of said fixing member to thereby coat a parting agent on said fixing member;

a feeding member rotationally in contact with said member by following rotation of said coating member to thereby feed the parting agent to said coating member;

a holding member holding the parting agent and held in sliding contact with said feeding member to thereby deposit said parting agent on said feeding member; and rotation limiting means for preventing, when said fixing member is rotated in a direction opposite to a direction assigned to fixation while causing said coating member to rotate, said feeding member from rotating by following rotation of said coating member, wherein a rotational speed of the coating member is controlled by a coefficient of friction between the coating member and the fixing member.

26. The fixing device as claimed in claim 25, wherein said fixing member further comprises:

a pair of fixing members, wherein an recording medium carrying a toner image thereon is passed through a nip between said pair of fixing members to have said toner image fixed by heat and pressure, said coating member is held in contact with an outside surface of at least one of said pair fixing members, said feeding member is held in contact with said coating member, and said holding member is held in contact with said feeding member.

27. The fixing device as claimed in claim 26, wherein one of said pair of fixing members comprises a heat roller while the other of said pair of fixing members comprises a press roller.

28. The fixing device as claimed in claim 26, wherein one of said pair of fixing members comprises an endless fixing belt passed over a plurality of support rollers while the other of said pair of fixing members comprises a press roller.

29. In an image forming apparatus comprising a fixing device, said fixing device comprising:

a fixing member;

a coating member rotationally in contact with a circumference of said fixing member by following rotation of said fixing member to thereby coat a parting agent on said fixing member;

a feeding member rotationally in contact with said coating member by following rotation of said coating member to thereby feed the parting agent to said coating member;

a holding member holding the parting agent and held in sliding contact with said feeding member to thereby deposit said parting agent on said feeding member; and rotation limiting means for preventing, when said fixing member is rotated in a direction opposite to a direction assigned to fixation while causing said coating member to rotate, said feeding member from rotating by following rotation of said coating member wherein a rotational speed of the coating member is controlled by a coefficient of friction between the coating member and the fixing member.

30. The apparatus as claimed in claim 29, wherein said fixing member further comprises:

a pair of fixing members, wherein a recording medium carrying a toner image thereon is passed through a nip between said pair of fixing members to have said toner image fixed by heat and pressure, said coating member is held in contact with an outside surface of at least one of said pair of fixing members, said feeding member is held in contact with said coating member, and said holding member is held in contact with said feeding member.

31. The fixing device as claimed in claim 30, wherein one of said pair of fixing members comprises at heat roller while the other of said pair of fixing members comprises a press roller.

32. The fixing device is claimed in claim 30, wherein one of said pair of fixing members comprises an endless fixing belt passed over a plurality of support rollers while the other of said pair of fixing members comprises a press roller.

33. The fixing device as claimed in claim 25, wherein an amount of parting agent coated in the fixing member is based on the coefficient of friction between the coating member and the fixing member.

34. The fixing device as claimed in claim 25, wherein a rotational speed of the feeding member is controlled by a coefficient of friction between the feeding member and the coating member.

35. The fixing device as claimed in claim 34, wherein an amount of parting agent coated in the coating member is based on the coefficient of friction between the feeding member and the coating member.

36. The image forming apparatus as claimed in claim 29, wherein an amount of parting agent coated in the fixing member is based on the coefficient of friction between the coating member and the fixing member.

37. The image forming apparatus as claimed in claim 29, wherein a rotational speed of the feeding member is controlled by a coefficient of friction between the feeding member and the coating member.

38. The image forming apparatus as claimed in claim 37, wherein an amount of parting agent coated in the coating member is based on the coefficient of friction between the feeding member and the coating member.

39. The fixing device as claimed in claim 25, wherein the rotation limiting means is a one-way clutch mounted on a bearing of the coating member.

40. The fixing device as claimed in claim 25, wherein the rotation limiting means is a one-way clutch mounted on a bearing of the feeding member.

41. The image forming apparatus as claimed in claim 29, wherein the rotation limiting means is a one-way clutch mounted on a bearing of the coating member.

42. The image forming apparatus as claimed in claim 29, wherein the rotation limiting means is a one-way clutch mounted on a bearing of the feeding member.

43. A image forming apparatus comprising a fixing device, the fixing device, comprising:

at least two fixing members, each of the at least two fixing members further comprising:

a coating member in contact with the fixing member, the coating member being configured to coat a parting agent on a surface of the fixing member;

a feeding member in contact with the coating member, the feeding member being configured to feed the parting agent to a surface of the coating member;

a holding member configured to hold the parting agent, the holding member being positioned in a sliding contact with the feeding member and being configured to deposit the parting agent on a surface of the feeding member; and limiting means for preventing the feeding member from rotating when the fixing member is rotated in a direction opposite to a fixing rotational direction, wherein a rotational speed of the coating member is controlled by a coefficient of friction between the coating member and the fixing member.

44. The image forming apparatus as claimed in claim 43, wherein an amount of parting agent coated in the fixing member is based on the coefficient of friction between the coating member and the fixing member.

45. The image forming apparatus as claimed in claim 43, wherein a rotation speed of the feeding member is controlled by a coefficient of friction between the feeding member and the coating member.

46. The image forming apparatus as claimed in claim 45, wherein an amount of parting agent coated in the coating member is based on the coefficient of friction between the feeding member and the coating member.

47. The image forming apparatus as claimed in claim 43, wherein the rotation limiting means is a one-way clutch mounted on a bearing of the feeding member.

48. The image forming apparatus as claimed in claim 43, wherein the rotation limiting means is a one-way clutch mounted on a bearing of the coating member.

* * * * *